US005198078A

United States Patent [19]

Gale et al.

[11] Patent Number: 5,198,078

[45] Date of Patent: Mar. 30, 1993

[54] PROCEDURE FOR ELECTROLYTE PRODUCTION OF MAGNESIUM

[75] Inventors: Charles O. Gale, Ogden, Utah; Clarence R. Townsend, Jefferson, Oreg.

[73] Assignee: Oregon Metallurgical Corporation, Albany, Oreg.

[21] Appl. No.: 737,437

[22] Filed: Jul. 29, 1991

[51] Int. Cl.[5] ..... C25C 3/04

[52] U.S. Cl. ..... 204/70; 204/245

[58] Field of Search ..... 204/64 R, 70, 243 R, 204/245

[56] References Cited

U.S. PATENT DOCUMENTS 4,055,474 10/1977 Sivilolti ..... 204/70

4,334,975 6/1982 Ishizuka ..... 204/70

*Primary Examiner*—Donald R. Valentine

*Assistant Examiner*—David Ryser

*Attorney, Agent, or Firm*—A. Ray Osburn

[57] ABSTRACT

A device for electrolytic production of elemental magnesium by electrolysis of magnesium chloride in a molten salt bath, including a magnesium transfer trough comprising a semicircular section of a standard steel pipe mounted straddling the upper edge of a steel cathode plate, with cross slots for utilization of the full channel, the trough everywhere curving away from its nearest approach to the anode surface, to minimize production of unwanted magnesium on its exterior surface. The method entails the use of a destructible spacer for placing the anode accurately in place between a pair of opposing cathode plates.

8 Claims, 6 Drawing Sheets

PROCEDURE FOR ELECTROLYTE PRODUCTION OF MAGNESIUM

BACKGROUND OF THE INVENTION

1. Field

This invention relates to procedures and apparatus for production of magnesium metal by electrolysis employing molten baths of magnesium chloride along with other, more electrolytically stable, metallic salts.

2. State of the Art

Magnesium metal is commonly produced by electrolysis, wherein a direct current flows through a molten bath of magnesium chloride and other metallic chlorides. Other metallic salts, including halides, have been used. With the chloride baths, the products of the electrolysis are typically gaseous chlorine, released from a positive pole, or anode, and liquid metallic magnesium produced upon a negative pole, or cathode. Typically, the anode is of graphite while the cathode is of steel. The molten salts of the electrolytic bath are chosen to be more dense than liquid magnesium metal, so that it migrates upwardly, adhering to the anode facing surface of the cathode. In most magnesium producing electrolytic cells, the magnesium must be transferred from a production chamber to a separate magnesium collection chamber. In some, the magnesium is caught by an upwardly sloping, inverted trough at the top of the cathode below the surface of the electrolyte, to flow non-turbulently to the collection chamber, where its density impels it to the top of the bath. Others use weirs, over which the top layer of magnesium/electrolyte mixture spills over into the collection chamber. Magnesium production apparatus and procedures are widely disclosed in numerous embodiments in technical publications and in prior patents. The latter include U.S. Pat. Nos. 3,396,094, 4,055,474, 4,604,177, 4,514,269, 4,560,449 and others to Sivilotti, along with U.S. Pat. No. 4,334,975 to Hiroshi Ishizuka, U.S. Pat. No. 4,198,282 to Andreassen, and others. U.S. Pat. No. 4,055,474, for example, discloses an apparatus comprising a row of spaced graphite anodes with planar surfaces each with an opposing planar cathode surface within the molten bath, along with-troughs for transfer of the magnesium.

For most efficient cell operation, the anode-cathode distances must be reduced to a practical minimum, while providing sufficient space for upward circulation of the bath impelled by the rising chlorine gas. The chlorine forms into a bubble layer which thickens upwardly along the anode, so that the anode-cathode distance is minimum at the bottom of the anode and increases upwardly to avoid constriction of electrolyte circulation. Inaccurate relative placement will result in uneven bath circulation and uneven current flow patterns, with attendant inefficiencies and potentially reduced anode life. Accurate cathode-anode placement cannot be directly measured within the molten bath, which may approach 1400° F. Prior art shows no effective method of accurately positioning of the anodes and cathodes within the molten bath.

The use of inverted trough collection leads to other cathode configuration and placement problems. The trough must be installed sufficiently distant from the anode face to avoid entrapping the upwardly rising chlorine bubbles. The recombination of chlorine and magnesium in the cells fortunately tends to occur slowly, but mixing in the trough is clearly undesirable.

The upper part of the cathode plate is typically angled relatively abruptly away from the anode surface. This provides clearance for the trough width while maintaining its distance from the anode face and the envelope of chlorine bubbles.

The problem of avoiding chlorine entrapment aside, the troughs must have sufficient flow capacity for non-turbulent transfer of the magnesium. Room for such troughs is also provided by the angled out configuration of the cathode plates. However, wide shallow troughs may require inefficient increase in cell dimension, although they tend to have desirably smaller outside flat surfaces on their anode side, which reduces unwanted magnesium production thereon. If the trough configuration is too wide and shallow, the cathode may necessarily be angled out so sharply that magnesium breakaway from its surface could occur. Deeper, narrower troughs may of course be used to provide the needed flow area, but such troughs tend to undesirably increase the anode adjacent area. For example, in U.S. Pat. No. 4,055,474, the upper edge of the cathode plate is shown curled toward the anode to provide the trough 46, which, for sufficient size, may require the cathode plate to depart too distantly from the anode, as put forth above. (Prior Art FIG. 10) Another trough design utilizes a ship channel 42. (Prior Art FIG. 8) However, the long vertical leg 43 of the channel provides trough depth but has a substantial flat vertical anode-facing surface. The straddled position of channel 42 reduces the required angle-out of the cathode plate 25, but the actual flow area of the channel is however severely limited by the cathode plate itself forming its outside boundary. Other trough embodiments include metal plates formed into downwardly opening channels, but share similar shortcomings, the cathode being the outside limit of the usable flow channel (Prior Art FIG. 9) U.S. Pat. No. 2,785,121 employs a deep side "U" shape, mounted in its entirety closer to the anode than any part of the vertical, planar, cathode employed.

A critical need remains for a cathode plate and associated trough design which will provide sufficient magnesium flow area and permit close placement of the trough with respect to the anode, along with practical means for accurately locating the anode and cathode structure within the molten bath of metallic salts.

BRIEF SUMMARY OF THE INVENTION

With the foregoing in mind, the present invention eliminates or substantially alleviates the shortcomings and disadvantages in prior art methods and apparatus for electrolytic production of magnesium, by providing an improved cathode-trough embodiment, along with procedures assuring minimum anode-cathode distances by precise positioning within the molten bath.

In common with prior designs, the cathode plate is angled outward more abruptly from the anode surface above its electrolytically active portion, to provide trough clearance. However, the severity of this outward angle is lessened by mounting the inverted trough straddled across the cathode plate. Magnesium cross-flow slots at the cathode plate upper edge assure utilization of the full trough flow area on both sides, permitting use of a substantially wide, relatively shallow trough. The trough is of curved outside shape on its anode side, allowing close approach with no vertical flat opposing area. The anode-to-trough current is therefore reduced, decreasing unwanted magnesium production on the outside of the trough. More elaborate trough configurations could be used, but a half section of standard pipe effectively and economically exploits the advantages of this trough design approach.

For precise placement in the bath, the anode incorporates an elongate spacer bar secured horizontally along its bottom edge. The spacer bar in thickness corresponds to the desired anode-cathode distance at that location. The cathode is pre-installed within the bath, with the anode subsequently submerged for installation. According to one preferred embodiment and procedure, the bar selected to be of wood or other organic material, so as to be consumed within the bath, but to survive in full dimension for a sufficient period to secure the graphite anode properly spaced from the cathode within the cell. In another preferred embodiment, the spacer may be of material, such as ceramic, selected to withstand the bath environment. In this embodiment, chlorine consumable steel bar to anode fasteners are used. With the first embodiment, the bar crumbles away after a brief period of time; in the second the spacer drops away as the steel fasteners are consumed.

It is therefore the principal object of the invention to provide improved apparatus and associated procedures for electrolytically producing magnesium from molten magnesium chloride.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
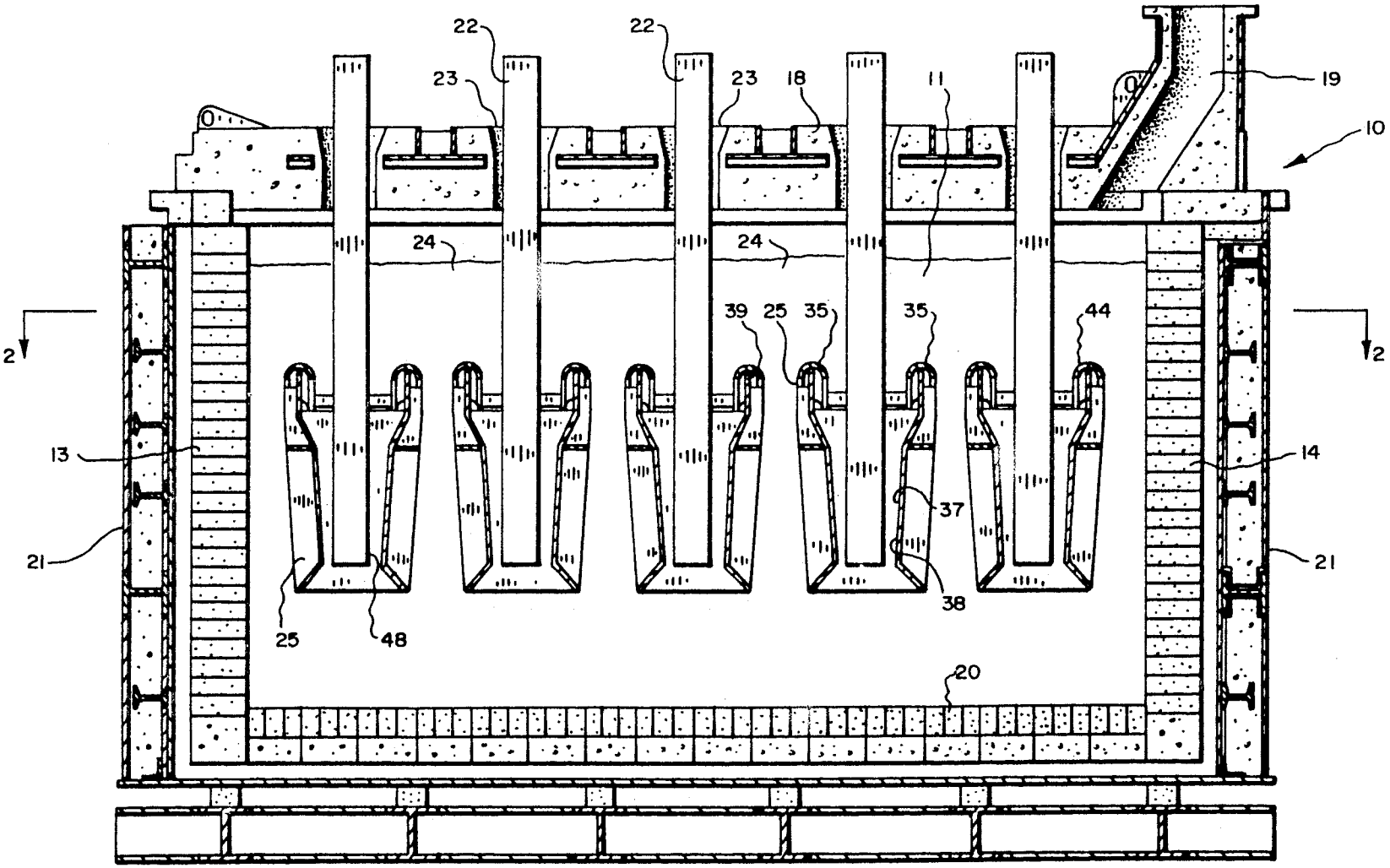
FIG. 1 is a vertical section view through an electrolytic cell for producing elemental magnesium by electrolysis of magnesium chloride, showing magnesium transfer troughs in accordance with the invention, drawn to a reduced scale, FIG. 2 a horizontal section view of the magnesium production cell of FIG. 1, taken along line 2—2 thereof at the top of the curtain wall openings above the cathodes, drawn to the same scale, FIG. 3 a cross sectional view of the magnesium production cell of FIG. 2, taken along line 3—3 thereof, drawn to the same scale, FIG. 4 a side elevational view of one of the cathode assemblies of the magnesium production cell of FIG. 1, drawn to a somewhat larger scale, FIG. 5 a vertical cross sectional view of the cathode assembly of FIG. 4, taken along line 5—5 thereof, showing also a fragment of an associated anode, drawn to approximately the same scale, FIG. 6 an enlarged scale view of a fragment of the cathode plate and attached transfer trough of FIG. 5, FIG. 6*a* a cross sectional view of a trough secured off center upon the upper edge of a cathode plate, drawn to the scale of FIG. 6, FIG. 7 an enlarged view of a fragment of the cathode of FIG. 4, drawn to an enlarged scale, showing the cross flow slots in the upper edge of the cathode plate, FIG. 8 a cross sectional view of a prior art magnesium transfer trough design, drawn to approximately the scale of FIG. 6, FIG. 9 a vertical cross sectional view of another prior art magnesium transfer trough secured to a cathode, drawn to the scale of FIG. 8, FIG. 10 a view of a fragment of a prior art magnesium transfer trough made by curl-forming the upper edge of a cathode plate, drawn to the scale of FIG. 8, and FIG. 11 a vertical cross sectional view of a lowermost portion of one of the cathodes of FIG. 1 along with a fragment of an associated anode, showing placement spacer bars therebetween, drawn to approximately the scale of FIG. 6.
Figure 2:
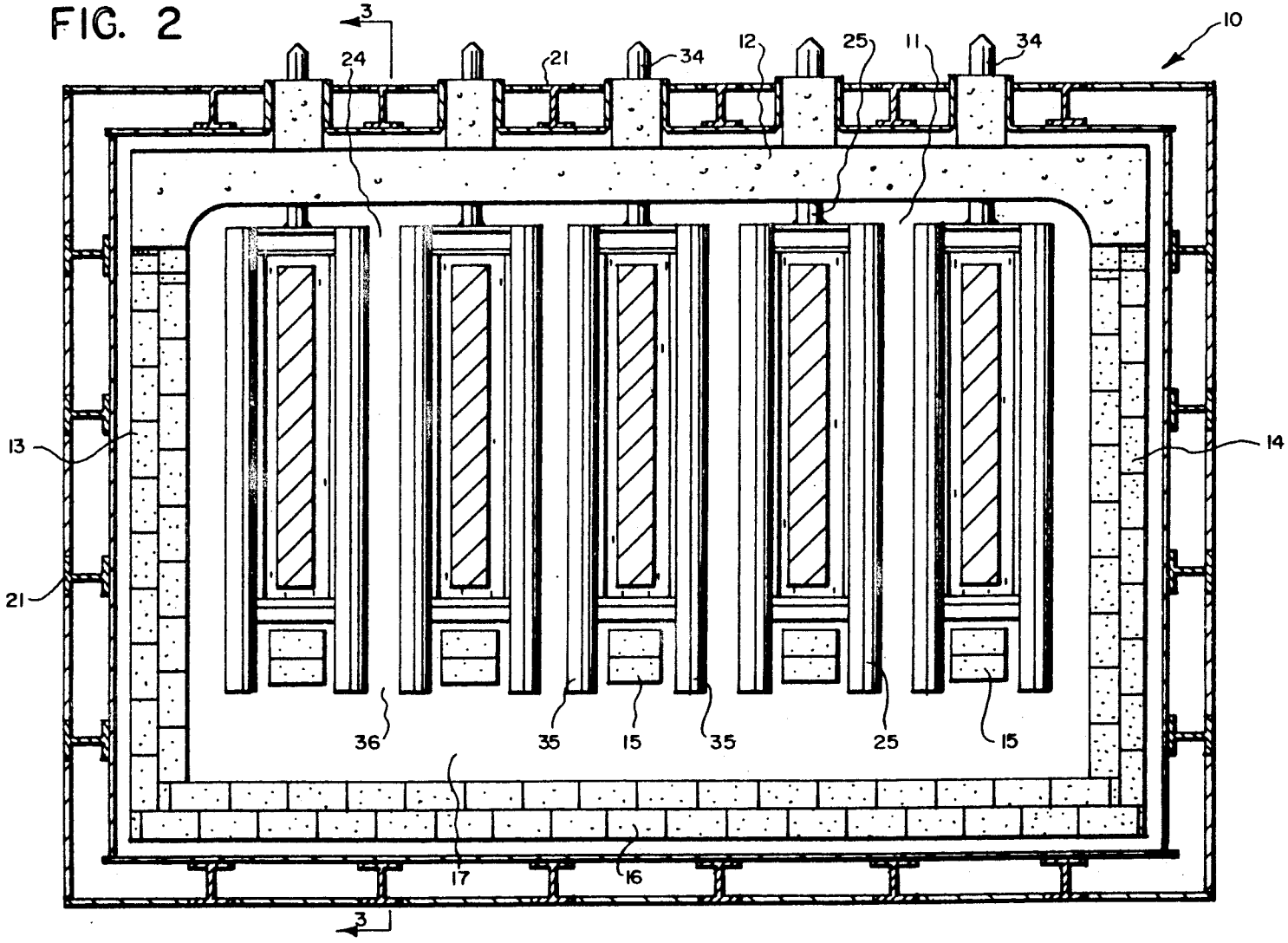
Figure 3:
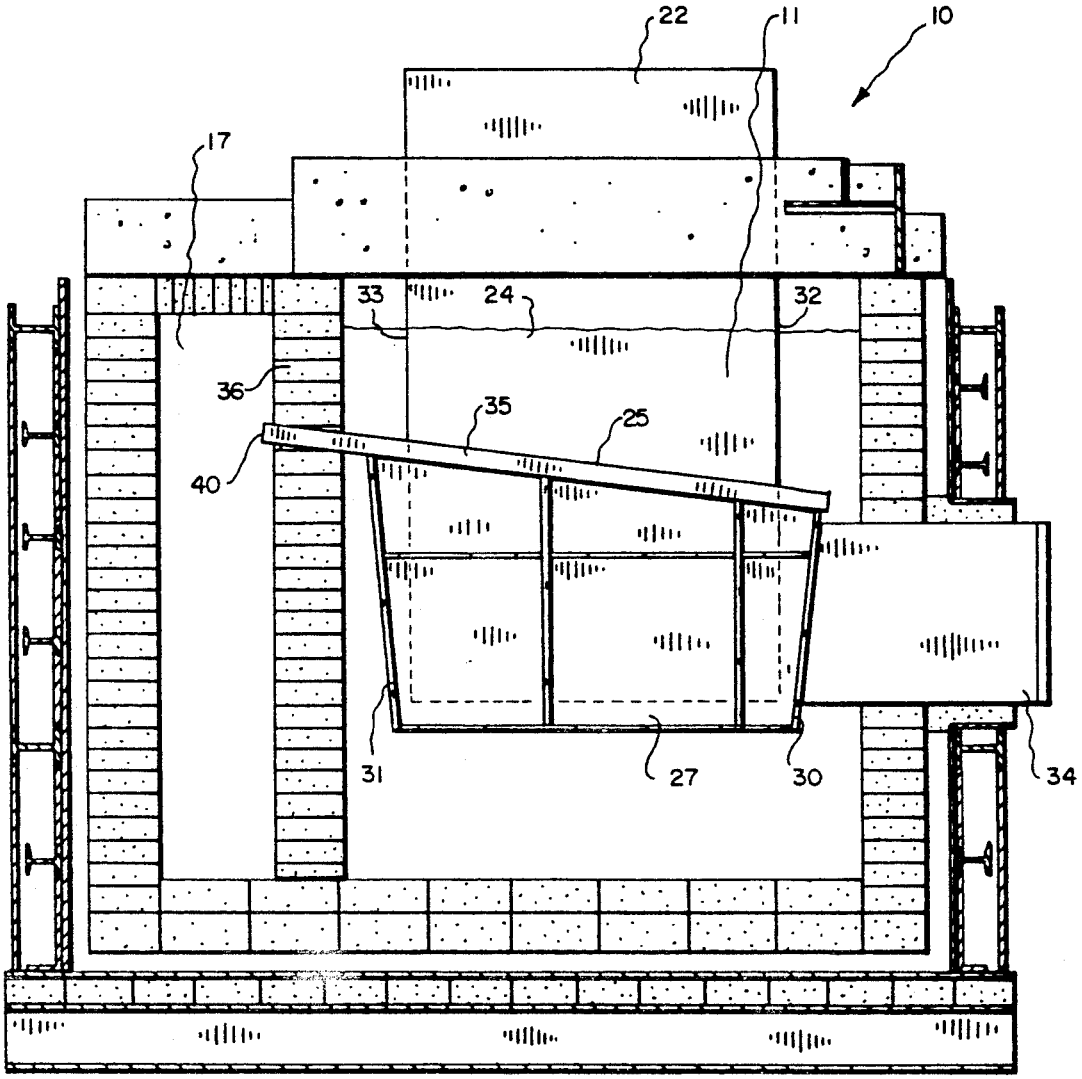
Figure 4:
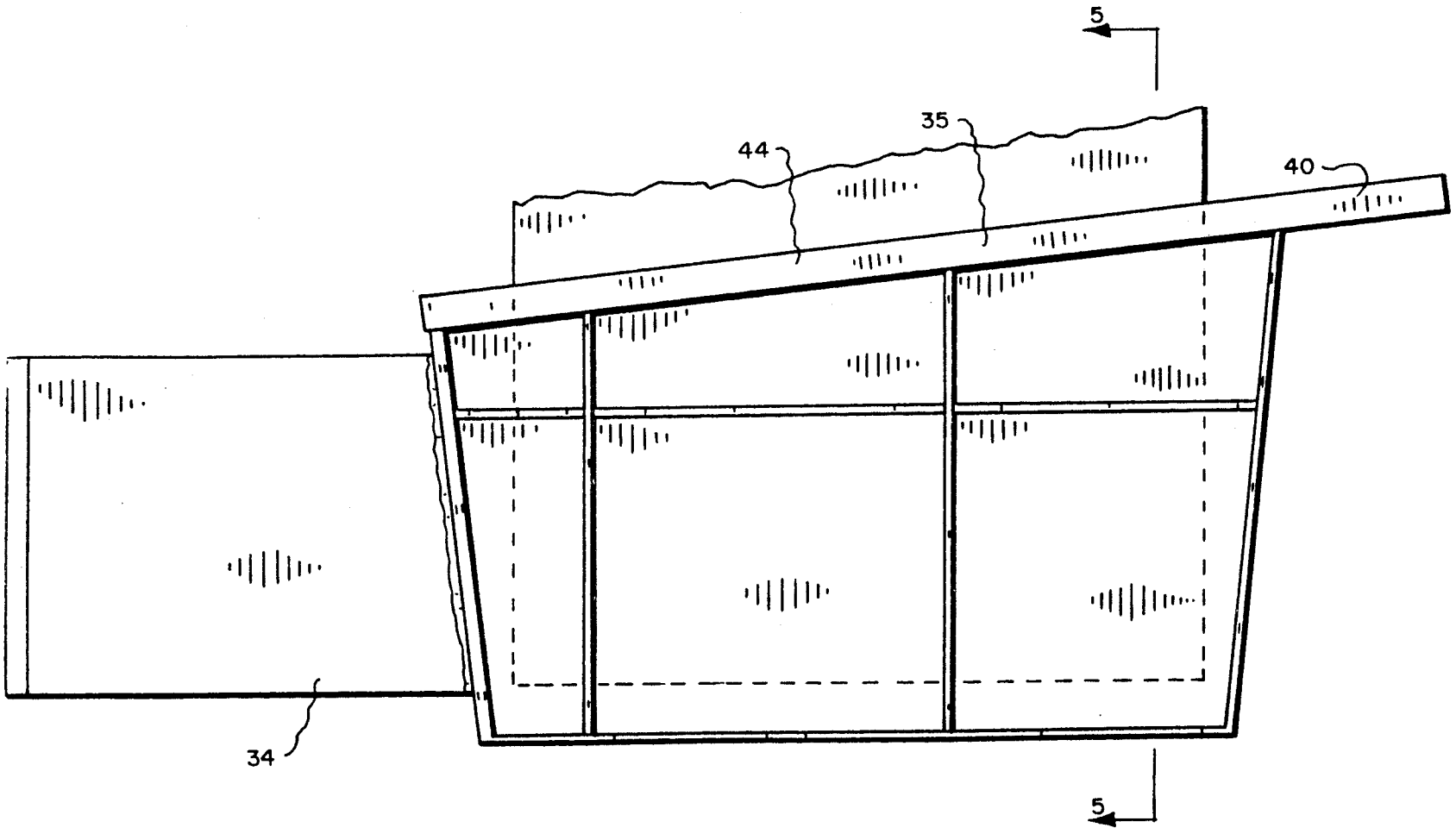
Figure 6A:
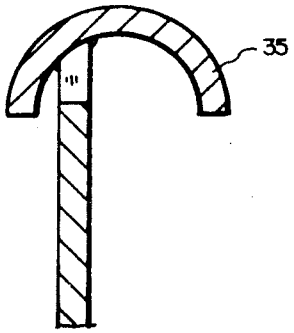
Figure 6:
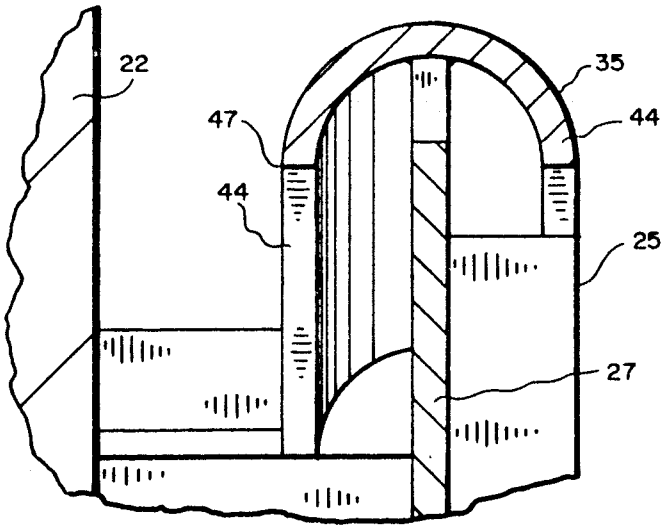
Figure 7:
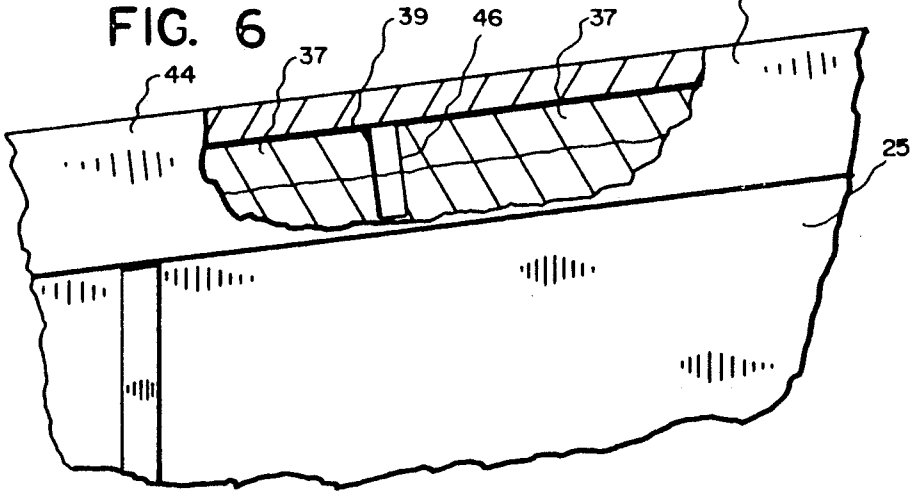

An embodiment of a magnesium production cell 10 in accordance with the invention is illustrated in FIGS. 1–7, which illustrate an apparatus employing electrolysis of magnesium chloride in a molten metallic chloride bath. The electrolytic cell structure 10, seen in plan view in FIG. 2, is rectangular, and comprises a main electrolysis chamber 11 with rear wall 12 defining its longer dimension, and end walls 13 and 14. The front side of chamber 11 is bounded by a partition or curtain wall 15. Between curtain wall 15 and a front wall 16 is a chamber 17 wherein the liquid magnesium produced is collected. Cell 10 further incorporates a sealed cover 18 with a cell-wide chlorine gas outlet channel 19 communicating with a chlorine collection and disposal means, not shown. (FIG. 1) All of the outside walls 12, 13, 14 and 16, as well as curtain wall 15 and floor 20 are constructed of refractory brick. Surrounding the entire cell 10 is a protective shell assembly 21 spaced outwardly from the refractory walls. In illustrative cell 10, five anodes 22, preferably and typically of graphite, are installed equally spaced, each extending through an appropriate opening 23 in top cover 18 into molten bath 24 in cell 10. Each anode 22 is formed as a slab of constant thickness, aligned from front to rear of main chamber 11. An anode support structure, not shown, is provided on cover 18, with attached electrical connection terminals, also not shown. Each anode electrical terminal may have a heat draining member for temperature control, not shown.

The cell 10 also includes a surrounding cathode structure 25, preferably of welded plate steel, paired with each anode 22. A pair of steel plates 26 and 27 are each positioned generally vertically but spaced horizontally from one of the broadsides 28 and 29 of its associated anode 22, integrally connected by a pair of welded end plates 30 and 31 similarly spaced from each anode end surface 32 and 33. (FIGS. 1, 4 and 5) Each cathode 25 carries a steel current conducting bar 34 welded to end plate 30 and extending through rear cell wall 12. The portion of bar 34 outside cell 10 may comprise an aluminum extension, not shown, carrying an electrical connection block, which is also not indicated, at its outermost end. Each cathode side plate 26 and 27 has a forwardly upward sloping uppermost edge, to which is secured a downwardly opening trough 35 immersed in bath 24, and extending over curtain wall 15 into magnesium chamber 17. (FIGS. 2 and 3) Curtain wall 15 has vertical openings 36 extending from the floor 20 to the top of cathodes 25, to allow free flow of the electrolyte bath 24 between main chamber 11 and forward chamber 17.

In operation of cell 10, liquid magnesium 37 is produced upon, and clings to, the anode facing surfaces 38 of cathode 25. Being of lesser specific gravity than the electrolytic bath 24, the liquid magnesium migrates upwardly along this surface. Secured to the top of each side plate 26 and 27 is the magnesium collecting, inverted, semicircular trough 35. The molten magnesium 37 flows upwardly along each trough 35 to the uppermost, spout, ends 40, to thereupon pour upward and rise to the surface of bath 24.

Figure 5:
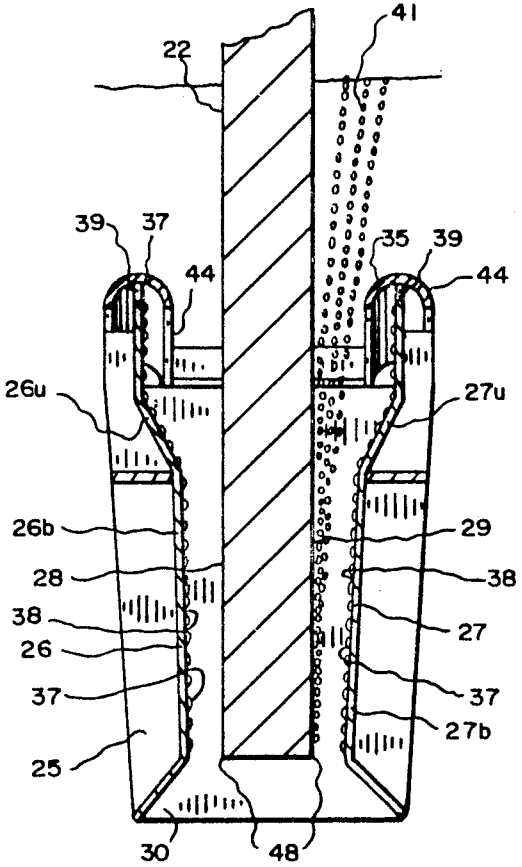

A bottom portion **26*b* and 27*b* of side plates 26 and 27, respectively, and each entire end plate 30 and 31, slope upwardly and outwardly away from associated vertical surfaces 28, 29, 32 and 33 of each anode 22. This provides an upwardly thickening flow channel for the non-turbulent circulation of bath 24 as it is drawn upward by the evolving chlorine 41. Laminar flow is required for efficient electrolytic action, and for avoiding dislodging the magnesium from the surface of the cathode plates. The plate outward slope minimizes the average cathode to anode distance for improved cell efficiency, while in general avoiding the chlorine 41, which forms into rising bubbles occupying an increasingly thick layer upon the anode surfaces 28 and 29. (FIG. 5**)

The upper, substantially inactive electrolytically, portions **26*u* and 27*u* of the side cathode plates angles relatively sharply away from anode 22, to provide clearance for the troughs 35 mounted at plate upper edges 39. The configuration and placement of troughs 35 with respect to anodes 22 is also important to cell efficiency. Current flows through bath 24 between the trough and anode, which leads to magnesium production on anode facing trough surfaces Magnesium produced in this location cannot be easily recovered from bath 24 in main chamber 11, which has no provisions for its harvest. To mount the troughs sufficiently distant from the anode to completely eliminate the magnesium deposit may require substantial cell enlargement, which would not be cost effective or efficient. Accordingly, trough 35 is typically spaced from anode 22** only far enough to avoid constricting the bath circulation, while avoiding chlorine entrapment.

Figure 9:
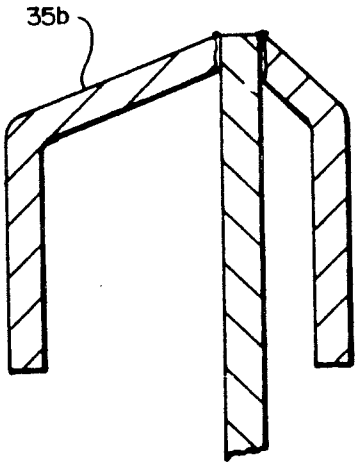
Figure 8:
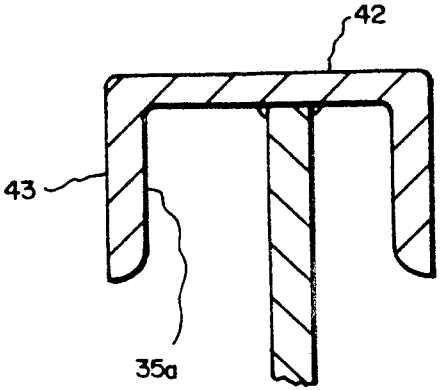
Figure 10:
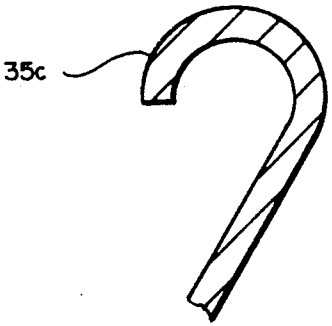

To provide sufficient magnesium flow area, trough 35 may be constructed relatively shallow and wide, or relatively deep and narrow. The former approach may lead to undesirably increased cell size, the latter to increased vertical area for undesired magnesium production. See Prior Art FIGS. 8, 9 and 10 for examples of previously employed trough configurations. The standard channel 42 of FIG. 8 provides a desirably narrow trough **35*a*, but with deep leg 43 unfortunately providing more than desirable anode facing area for unwanted metal production. The formed plate trough 35*b* of FIG. 9 is similar to the channel 42, and shares the same disadvantages. U.S. Pat. No. 4,055,474 discloses conceptually illustrated troughs 46 (35*c* in FIG. 10) formed by curling the upper edges of the cathode side plates, or by attaching the curled portion separately. The resulting curved cross section trough 35*c* desirably reduces the anode adjacent area for metal deposit. However, construction of the troughs 35*c* from heavy cathode plate material is exceedingly difficult, and may require prohibitively expensive forming tooling. In any event, provision of flow areas comparable to those of trough 35** requires complex curvature, and substantially increased upper plate angle. Too sharply angled upper plates carry danger of magnesium dislodging from turbulence arising from the abruptly expanding flow channel. Also, although the acceptable limit is not known, sharply angling plates are potentially associated with magnesium dislodgment even without flow turbulence.

The illustrated embodiment of trough 35 comprises a semicircular half 44 of a standard steel pipe of a size selected to provide ample liquid metal flow area for the associated cell design. Precise requirements are difficult to predict, depending upon cathode size, bath characteristics and amperage. Half pipes of nominal diameter of 4", for example, appear to be adequate for commonly employed cell sizes operating at state of the art amperages.

To reduce sharpness of the bend of the plates 26 and 27, it is preferred to mount trough pipe 44 in straddling position on upper edges 39. To assure the utilization of the entire flow area of half pipe 44, spaced apart cross flow slots 46 are provided through the top rim 39 of the cathode side plates. Trough 35 is shown centered on the cathode plate, but could be mounted off center to further reduce the upper plate angle, or the inactive portion of the plate. (FIG. **6*a***)

The nearest approach of half pipe 44 to anode 22 is edge 47 which in theory could be a line of single point width, and in practice may be constructed to approach such a line. Current flowing from anode 22 to half pipe 44 will be strongly constrained to pass through or near edge 47, to utilize the shortest current path, which is of least resistance. It is expected that the current path in this area will accordingly be extremely thin, and that attendant magnesium production will be sharply reduced, and may not occur at all.

Figure 11:
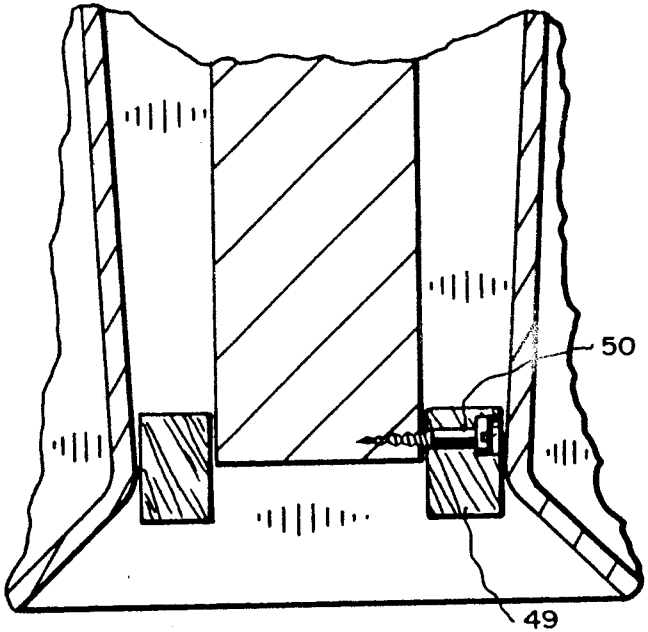

The efficiency of cell 10 is reduced if the cathodes 25 are not accurately placed with respect to the anodes 22 within the hot bath 24. Uneven current patterns may occur in that event, so that portions of the bath are poorly utilized and others perhaps overly electrolyzed. Circulation becomes uneven, and the anodes unevenly consumed. For best performance, the cathode plates 26 and 27 should at their closest, lowermost, approach to anode 22 be only about 1½" removed, and very evenly centered. (FIGS. 5 and 11) The cathode may be constructed with great precision, and accurately pre-placed in the bath 24. However, precise knowledge of the locatior of the lower edges 48 of anode 22 is not possible during its subsequent immersion and installation within the cathode 25 immersed in the molten bath 24. A spacer strip 49 of wood is planed to the desired anode-to-anode distance at the bottom edge 48, and secured as by metallic lag screws 50. (FIG. 11) The wood of spacer 49 carbonizes (pyrolyzes) from the elevated temperature, but retains its shape because actual combustion is prevented by the absence of oxygen, guiding anode 22 as it is lowered into final position and secured. Spacers 49 soon thereafter crumble, permitting upward circulation of electrolyte as required for operation of cell 10. Lag screws 50 are in due course consumed by the chlorine 41 produced at anode 22.

Numerous details of the device and method as shown and described may be changed without departing from the spirit of the invention. While the embodiment of the trough 35 employing the straddling half pipe 44 is economical and effective, other configurations may be used, providing that the vertical area of closest approach to the anode is substantially limited, and that trough flow area outside the cathode plate is utilized. Similarly, although a spacer 49 of hard wood has been employed with excellent results, other organic, pyrolizable materials could be used. Also, non-consumable, relatively dense, materials such as alumina or silica containing ceramics could be used. However, in this event, disposal of the spacer would occur by detachment from the anodes by consumption of the steel bolts 50 by the evolving chlorine.

Although the devices and methods are described and illustrated with respect to magnesium production in particular, they could be equally well applied to electrolytic production of other metals. The invention may be embodied in other specific forms without departing from the spirit or essential characteristics thereof. The present embodiments and methods are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A procedure for electrolysis of magnesium chloride to produce free magnesium metal, including the steps:

maintaining, in an enclosed cell, a molten electrolytic bath containing magnesium chloride for electrolysis, the density of said bath being greater than that of free magnesium metal;

passing direct electric current through the bath between at least one anode and at least one cathode plate in contact with the bath for depositing free magnesium metal at the cathode plate for upward flow therealong, and evolving chlorine gas at the anode for upward travel through the electrolytic bath, wherein the cathode plate has a major active surface that faces and slants upwardly away from a portion of the surface of the anode, the cathode plate sloping relatively abruptly away from the anode above the major surface, and having an uppermost edge which slopes upwardly parallel to the anode face beneath the surface of the bath; wherein an inverted steel magnesium transfer trough is provided extending to a magnesium collection chamber in the cell, the trough having a downwardly open magnesium flow channel, and being mounted above, along and straddling the uppermost edge of the cathode plate, so that the magnesium flow channel comprises a portion nearer to, and a portion farther from, the anode than the uppermost edge of the cathode plate; and cross flow passage means connecting the flow channel portions.

2. The procedure of claim 1, wherein:

the exterior surface of the trough, at least on the side thereof facing the anode, is everywhere curved away therefrom.

3. The procedure of claim 2, wherein:

the trough is welded to the upper edge of the cathode plate; and the cross flow passage means comprise spaced apart slots across the uppermost edge of the cathode plate.

4. The procedure of claim 2, wherein:

the trough comprises an arcuate section of steel pipe.

5. A procedure for electrolysis of magnesium chloride to produce free magnesium metal, including the steps:

maintaining, in an enclosed cell, a molten electrolytic bath containing magnesium chloride for electrolysis, the density of said bath being greater than that of free magnesium metal;

providing and securing within the cell a cathode structure having at least one cathode plate with a major active surface slanting upwardly away from the vertical direction;

providing a graphite anode with at least one planar surface to be installed in the bath with the planar surface vertical and facing the major active surface of the cathode;

providing an elongate horizontal spacer bar secured along the bottom edge of the side of the anode which faces the cathode, the thickness of the spacer bar conforming to an anode-to-cathode distance at the lowermost edge of the cathode major active surface selected for efficient operation of the cell, said spacer bar being removable from the anode by action of the bath containing cell;

placing the anode downwardly into the bath and securing it therein so that the cathode facing surface thereof is vertical and the elongate outside surface of the spacer bar is against the cathode plate at the bottom edge of the major active surface thereof; and allowing the spacer bar to be removed from between the anode and the cathode by action of the cell.

6. The procedure of claim 5, wherein:

the spacer bar is of organic material, which initially pyrolyzes while remaining of original shape and size, and subsequently crumbles from the heat of the bath, to fall away from the space between the anode and cathode.

7. The procedure of claim 6, wherein:

the spacer bar is of wood.

8. The procedure of claim 5, wherein:

the spacer bar is constructed of heat and bath resistant refractory material secured to the anode by steel fasteners, so that the spacer bar is initially retained in place and is subsequently detached from the anode by the action of chlorine upon the fasteners, to fall from between the anode and the cathode.

* * * * *